US005577403A

United States Patent [19]

Steeley

[11] Patent Number: 5,577,403

[45] Date of Patent: Nov. 26, 1996

[54] KEY IDENTIFICATION SYSTEM

[76] Inventor: Larry J. Steeley, 6004 Brookhill Cir., Birmingham, Ala. 35242

[21] Appl. No.: 337,730

[22] Filed: Nov. 14, 1994

Related U.S. Application Data

[63] Continuation-in-part of Ser. No. 6,161, Mar. 22, 1993, Pat. No. Des. 352,600.

[51] Int. Cl.[6] ..... A44B 15/00; E05B 19/24

[52] U.S. Cl. ..... 70/456 R; 70/457; 70/458; 70/459; 70/460; 40/323; 40/634

[58] Field of Search ..... 70/456 R, 457–460, 70/408; 40/323, 330, 634, 639; 206/37–37.8, 0.8, 0.82–0.84

[56] References Cited

U.S. PATENT DOCUMENTS

| | | | |
|---|---|---|---|
| D. 352,600 | 11/1994 | Steely | D3/208 |
| 1,119,511 | 12/1914 | Hough | 206/0.82 |
| 1,338,181 | 4/1920 | Kalkbrenner | 40/634 |
| 2,566,118 | 8/1951 | Corwin et al. | 70/456 R |
| 2,597,227 | 5/1952 | Colliton | 206/0.82 |
| 2,769,331 | 11/1956 | Ellenbogen | 70/456 R |
| 3,094,799 | 6/1963 | Hines | 40/634 |
| 4,306,433 | 12/1981 | Kelly | 70/456 R |
| 4,309,883 | 1/1982 | Brentini | 70/456 R |
| 4,789,573 | 12/1988 | Jenkinson | 40/330 |
| 5,038,590 | 8/1991 | Sawyer et al. | 70/408 |
| 5,083,662 | 1/1992 | Bishop et al. | 70/456 R |
| 5,113,602 | 5/1992 | Levine et al. | 40/330 |
| 5,181,605 | 1/1993 | Bishop et al. | 70/456 R |
| 5,291,768 | 3/1994 | Rieffel et al. | 70/460 |

FOREIGN PATENT DOCUMENTS

| | | | |
|---|---|---|---|
| 2258812 | 8/1975 | France | 70/456 R |
| 1232004 | 5/1971 | United Kingdom | 206/0.82 |

*Primary Examiner*—Lloyd A. Gall
*Assistant Examiner*—Tuyet-Phuong Pham
*Attorney, Agent, or Firm*—Veal & Marsh

[57] ABSTRACT

An identification system utilizes a plastic housing which is appropriately sized to hold either a key or a coin as well as an information sheet on which the user may place selected indicia referring to the key or to himself. Each embodiment utilizes a living hinge closure attachment to secure the key or coin and information sheet within the housing. Utilizing the housing as the indicia for identifying the key minimizes the excess material and connections thereby simplifying the identification and storage problem, yet because the use of the housing with the key slightly increases the size of the key head, it provides a slightly greater moment arm for turning the key in a lock and gives a slightly larger gripping surface to be employed when so turning the key. These factors are significant when dealing with children and with elderly people who may not have the physical strength and dexterity required for some small headed keys. When my device is used with coins inserted it is envisioned that the user would at all times have in his housing attached to his key information about himself and sufficient change to operate a pay telephone.

3 Claims, 3 Drawing Sheets

KEY IDENTIFICATION SYSTEM

This is a continuation in part application of U.S. patent application Ser. No. 29/006,161 filed Mar. 22, 1993 now U.S. Pat. No. Des. 352,600.

FIELD OF THE INVENTION

The present invention relates to systems for identification of such diverse things as keys and children. More particularly the present invention relates to a housing specifically designed to encase a foldable form or other material on which identifying indicia are placed and either an associated key or a coin. The usage of the invention with a key or set of keys enables one unfamiliar with the key to associate the key with its proper use, whereas the usage with a child's key enables the child or someone trying to assist the child to contact an appropriate guardian.

BACKGROUND OF THE INVENTION

At one time in society, it was virtually unnecessary to lock one's doors. Buildings and carriages were safe from general mischief except from a very small number of trouble makers. The later half of the twentieth century has seen a marked change in culture such that today, people lock their doors when they are within their homes and upon virtually every occasion of their leaving home. Likewise, travelers routinely lock the doors of their vehicles not only when they leave them but also while inside them. Security has become an issue and locks have abounded.

Typically a man will carry with him a house key, one or two car keys, an office key, a desk key, perhaps a bathroom key, and at least one other key entrusted to him by someone else. Around a business numerous keys are used for everything from storage areas to conference areas to security areas to offices. The locksmith is a frequent visitor at some establishments to change out the locks or to open a lock for which no key can be found. Heretofore, it has been known to tag each key as with a disk attached by a string or wire and write thereon the identification of the associated lock. Alternatively, some have considered using plastic strips to color code the keys and locks. Of course locksmiths have numbered their companion keys and locks for years. Nonetheless, a need persists for a way to easily and uniformly identify a key to a lock.

In yet another aspect of the background of this invention, the key or key chain has become the universal constant which all members of society are likely to carry with them. A driver of a vehicle cannot generally operate the vehicle without a key and a latchkey kid going home from school alone cannot get into his own home without a key. The proliferation of locks has made the key the single most commonly carried personal article. Yet, one key looks like another of the same manufacturer and if the owner is unable to identify his key it is unlikely that any one else can do so.

To solve this at least one organization has provided its members with metallic discs which fit on key rings and provide a national telephone number to assist in returning lost keys. Such programs are laudable, but they are of limited use when an emergency leaves the key owner unable to identify himself to authorities.

SUMMARY OF THE INVENTION

It is an object of this invention to assist in the identification one or more keys with their specific locks.

Yet another object of the invention is to provide a means for identifying the possessor of a key and to provide a means for reaching an appropriate person if an emergency exists.

Still another object of the invention is to make the identified key easier to use.

These and other objects and features of the invention are advantageously accomplished in the various embodiments of my invention as set forth hereinafter. In each embodiment I utilize a plastic housing which is appropriately sized to hold either a key or a coin as well as an information sheet on which the user may place selected indicia referring to the key or to himself. In each embodiment I utilize a living hinge closure attachment to secure the key or coin and information sheet within the housing. By utilizing the housing as the means for identifying the key I minimize the excess material and connections thereby simplifying the identification and storage problem, yet because the use of the housing with the key slightly increases the size of the key head, it provides a slightly greater moment arm for turning the key in a lock and gives a slightly larger gripping surface to be employed when so turning the key. These factors are significant when dealing with children and with elderly people who may not have the physical strength and dexterity required for some small headed keys. When my device is used with coins inserted it is envisioned that the user would at all times have in his housing attached to his key information about himself and sufficient change to operate a pay telephone.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENTS

Figure 1:
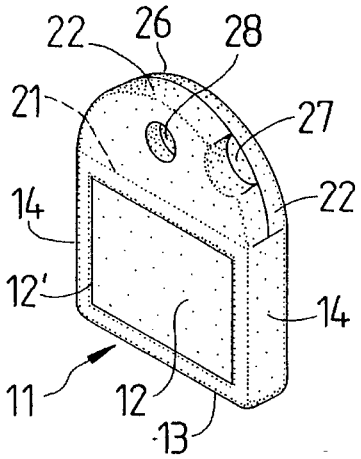
FIG. 1 is a perspective view of an embodiment of the invention.
Figure 2:
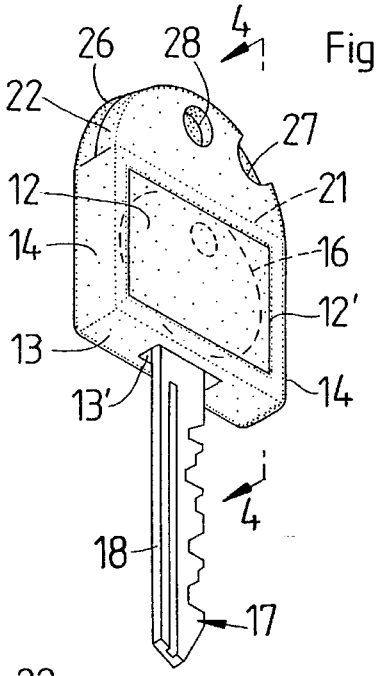
FIG. 2 is a bottom perspective view of the present invention showing a key encased therein.
Figure 3:
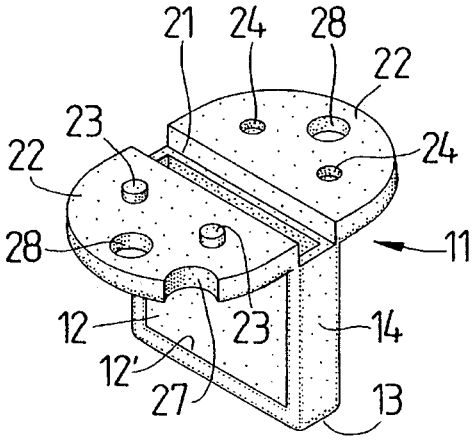
FIG. 3 is a perspective view of the present invention in an open position.
Figure 4:
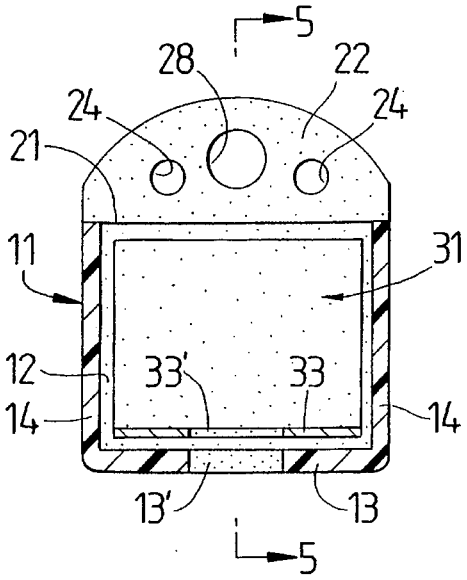
FIG. 4 is a sectional view taken along line 4—4 of FIG. 2.
Figure 5:
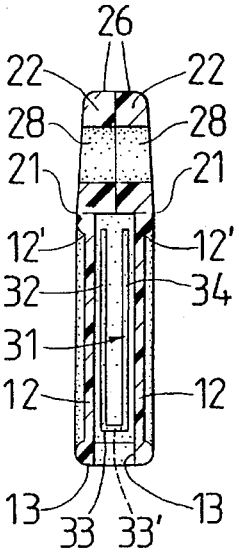
FIG. 5 is a sectional view taken along line 5—5 of FIG. 4.

Referring to the Drawings for a clearer understanding of the invention, it may be seen in FIG. 1 that the system which I have invented includes a plastic housing 11 having opposed planar side walls 12, and end wall 13, and a pair of longitudinal walls 14 connecting the side walls 12 and the end wall 13 in orthogonal relationship. The side walls 12 may have formed on their surface a slight peripheral projection 12' or offset such that the large external surface area of the side wall is recessed. In this embodiment, the interior volume of the housing is just large enough to receive therein a head portion 16 of a key 17. The key 17 also includes a shank portion 18 which extends through a slot 13' in end wall 13.

Affixed to the housing by a living hinge connection 21 is a closure which includes in this embodiment a pair of closure panels 22. The closure panels 22 are movable from a closed abutting position to an open displaced position. In the closed abutting position the panels are connected by cooperative pins 23 and sockets 24 formed in the confronting surfaces thereof. Alternative connectors such as a groove and spline may be formed in these confronting surfaces to hold them in abutment. As may be seen in the FIGS. 1–5, the panels 22 have a generally arcuate outer edge 26 extending from near the living hinge 21 adjacent one longitudinal wall 14 to near the living hinge adjacent the other longitudinal wall 14. To facilitate opening the closure one of the edges 26 has a scalloped indentation 27 formed such that the edges may be accessed and forced apart.

The panels 22 each have an aligned aperture 28 extending therethrough such that a key ring may pass through both panels 22. It should be noted that the ring passing through the apertures 28 would further prevent the loss of the key 17 if the panels became disengaged. An important aspect of the invention is the inclusion within housing 11 of a removable foldable liner material or sheet 31 having at least one side thereof suitable for placing some indicia thereon. In the above described embodiment sheet 31 is formed such that it may be folded with a first portion 32 commensurate with one of the side walls 12, a second portion 33 commensurate with the end wall 13 and a third portion 34 commensurate with the opposite side wall. Second portion 33 has a cooperative slot 33' formed therein for alignment with slot 13'. Housing 11 is made from a clear or nearly transparent plastic such that the interior of the housing is visible. Accordingly the indicia placed on the sheet 31 can be discerned without removing the sheet 31. The indicia placed on the sheet are such that the key 17 may be matched to a particular lock, so that if a plurality of keys i.e. door lock keys are all provided with individual housings and sheets each may be readily identified by writing the corresponding room number or other designation on the sheet 31, folding the sheet 31 to receive the appropriate key 17, inserting the sheet and key into the housing, securing the closure and placing the ring through the apertures 28. With all the keys thusly identified each key can be quickly identified and matched to the appropriate door. If the user desires the portions 32 and 34 of the sheet may carry the same indicia or one portion may have instructions thereon specific to the key or locked area, eg. a warning that the lock secures a hazardous area, or instructions to return the key to a specific storage area. Whether the keys for an area are kept on a ring or on a peg board, the present invention facilitates their identification.

Figure 6:
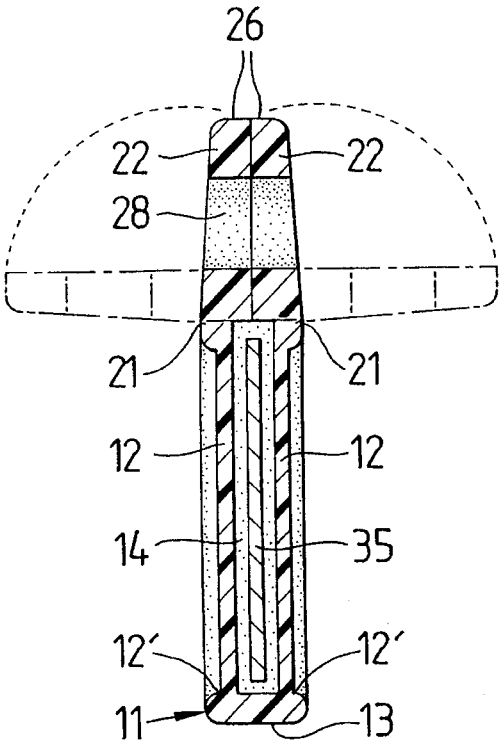
FIG. 6 is a sectional view of a second embodiment wherein a coin is retained within the housing.

The present invention may also be used in a variant form for the purpose of identifying the possessor of the key. Referring to FIG. 6, it will be recognized that the head of a key is generally about the same size as a quarter. Thus, if housing 11 is made such that a quarter fits within the internal volume, then the sheet 31 may be used to place indicia thereon such as emergency information which could be used to direct the administration of or summon aid to the possessor if he is unable to communicate. Further, if adopted and understood the housings themselves may be tinted with a color which would indicate to emergency response personnel that the possessor or someone with access to the key requires special attention. For example, diabetics might be given yellow tinted housing to use with their keys, epileptics might be given green tinted housings, AIDS victims might be given red tinted housings, etc. Additionally, in this embodiment the housing would contain a quarter 35 so that a pay telephone could be accessed to summon aid or notify a person identified on the sheet 31. The accommodation of the quarter would necessitate affixing the key to the housing with a ring or chain passing through apertures 28, however the housing is no larger than many decorative ornaments attached to key chains and would not interfere in any manner with the keys. This embodiment is intended primarily for use with adults although it may be used with children or even pets if the sheet is waterproof, such that the indicia are not removed during normal wear.

Figure 7:
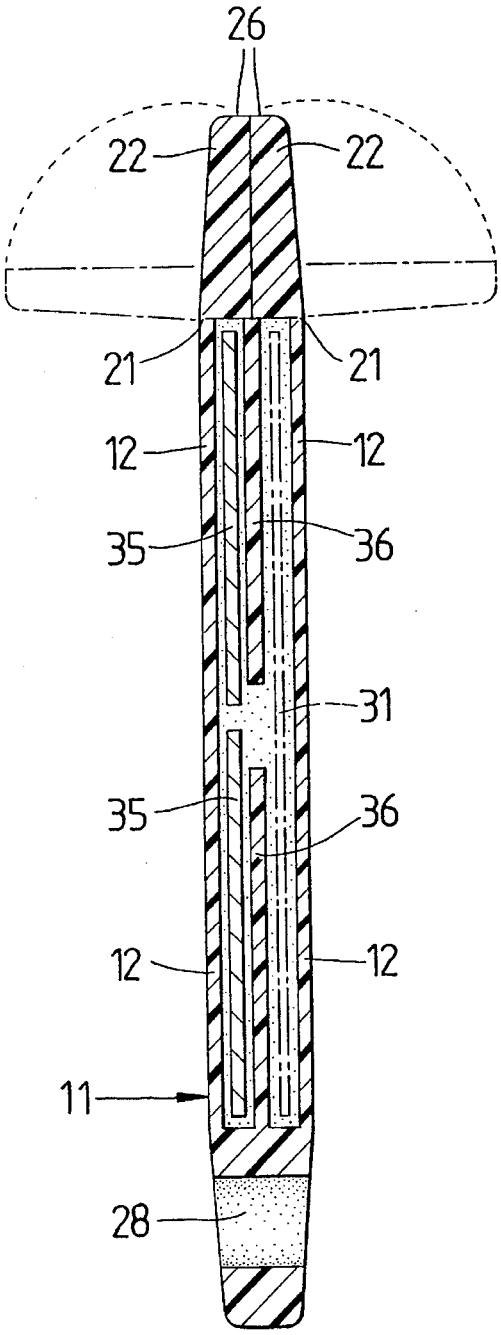
FIG. 7 is a sectional view of a third embodiment wherein more than one coin is retained in the housing.
Figure 8:
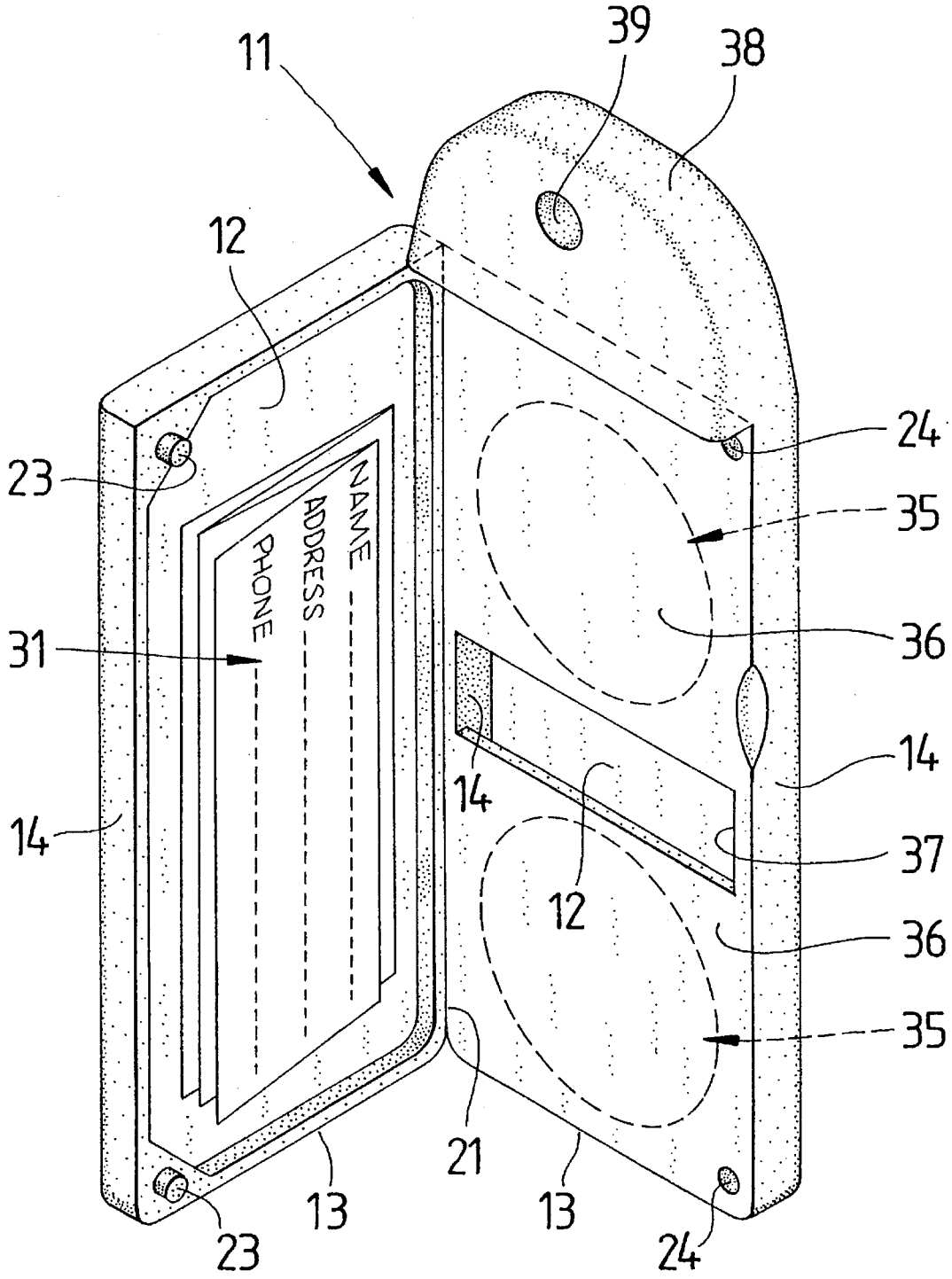
FIG. 8 is a perspective view of a fourth embodiment.

An alternative embodiment is shown in FIG. 7. In the previous embodiments sheet 31 was shown as folded about the quarter or key and was visible through the housing. It has been learned that when the above embodiments are used with children, the indicia on the sheet 31 are likely to be rubbed off by interaction with the coin or key and a single quarter is sometimes insufficient for the child to reach a parent or guardian. Accordingly, a third embodiment of the invention is presented in FIG. 7, wherein the housing 11 is elongated and wherein a partition 36 is formed such that a pair of quarters can be placed in the housing on one side of the partition and a folded sheet 31 may be placed on the other. The partition need not be extended over the entire length of the housing and may be divided near the middle of the housing for manufacturing purposes. The closure of this embodiment operates in the same manner however, an alternative closure may be used as shown in FIG. 8 wherein the living hinge 21 is formed along a longitudinal side and the pins 23 and sockets 24 or other engaging elements are formed along the length of the opposing longitudinal side, with the partition 36 having a center opening 37 such that quarters 35 could be inserted thereinto and the sheet 31 laid atop the partition before closing the housing. In this embodiment the end portion 38 is curved in the same manner as the closure panels of the prior embodiment and an aperture 39 is provided therethrough for the insertion of a key ring or chain. Due to the easy access of the embodiment the housing may be made of an opaque plastic and may have emergency instructions printed thereon directing one in how to open the housing to find the sheet 31.

While I have shown my invention in several forms, it will be obvious to those skilled in the art that it is not so limited but is susceptible of various changes and modifications without departing from the spirit thereof.

What I claim is:

1. An identification system comprising: a plastic housing having sufficient interior volume to contain at least one US quarter, in close confronting relationship; a closure comprising at least one panel independently hingededly connected to said housing and movable from a contacting closed position sealing said interior volume to a disengaged open position and means for detachably connecting said panel in said closed position wherein said housing comprises side walls extending between an endwall and said closure and longitudinal walls connecting said side walls and an endwall in orthogonal relationship therewith and further comprising an internal wall extending from said endwall and said longitudinal walls dividing said internal volume into two longitudinal compartments; and, a length of foldable material having a length and width commensurate with said interior volume such that when folded said material is coextensive with the dimensions of said volume, said material having at least one face on which indicia may be applied.

2. The identification system as defined in claim 1 wherein said internal volume is sufficient to receive the head portion of a key therewithin and wherein said housing has a slot formed therein through which the shank portion of said key may extend.

3. The identification system as defined in claim 1 wherein said housing is transparent such that said indicia may be seen therethrough.

* * * * *